US011619233B2

(12) United States Patent
Gray

(10) Patent No.: US 11,619,233 B2
(45) Date of Patent: Apr. 4, 2023

(54) ENCLOSURE SYSTEM INCLUDING WIRE MESH AND THIN NON-POROUS MEMBRANE PANELS

(71) Applicant: Edwards Limited, Burgess Hill (GB)

(72) Inventor: Malcolm William Gray, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 1089 days.

(21) Appl. No.: 16/323,927

(22) PCT Filed: Aug. 9, 2017

(86) PCT No.: PCT/GB2017/052354
§ 371 (c)(1),
(2) Date: Feb. 7, 2019

(87) PCT Pub. No.: WO2018/029475
PCT Pub. Date: Feb. 15, 2018

(65) Prior Publication Data

US 2019/0170142 A1 Jun. 6, 2019

(30) Foreign Application Priority Data

Aug. 11, 2016 (GB) ..... 1613794

(51) Int. Cl.
*E04B 1/92* (2006.01)
*F04C 28/28* (2006.01)
(Continued)

(52) U.S. Cl.
CPC ..... *F04C 28/28* (2013.01); *F04C 25/02* (2013.01); *E04B 1/92* (2013.01); *F04D 17/168* (2013.01); *F04D 19/04* (2013.01)

(58) Field of Classification Search
CPC ..... E04B 1/92; F04C 28/28; F04C 25/02
See application file for complete search history.

(56) References Cited

U.S. PATENT DOCUMENTS 4,325,309 A 4/1982 King et al.
6,119,422 A 9/2000 Clear et al.
(Continued)

FOREIGN PATENT DOCUMENTS

CN 202182221 U 4/2012
DE 102010046504 A1 3/2012
(Continued)

OTHER PUBLICATIONS

Combined Search and Examination Report under Sections 17 and 18(3) dated Feb. 13, 2017 in counterpart GB application No. GB1613794.5, 9 pp.
(Continued)

*Primary Examiner* — Babajide A Demuren
(74) *Attorney, Agent, or Firm* — Shumaker & Sieffert, P.A.

(57) ABSTRACT

An enclosure system may be formed of a lightweight panel with a thin non-porous membrane that enables the extraction and leak detection of hazardous gases from housing equipment such as vacuum pumps, valves, abatement equipment and the like. Additionally, the enclosure system includes a one or multiple layers of wire mesh which prevent projectiles with a high kinetic energy from escaping from the housing equipment thereby minimising the risk of an explosion causing parts or panels to be ejected from the enclosure system.

12 Claims, 2 Drawing Sheets

(51) Int. Cl.

| | |
|---|---|
| ***F04C 25/02*** | (2006.01) |
| *F04D 17/16* | (2006.01) |
| *F04D 19/04* | (2006.01) |

(56) References Cited

U.S. PATENT DOCUMENTS

| | | | | |
|---|---|---|---|---|
| 10,153,546 | B2 | 12/2018 | Kolak et al. | |
| 2011/0123355 | A1* | 5/2011 | Davidson | F04D 17/168 417/313 |

FOREIGN PATENT DOCUMENTS

| | | | |
|---|---|---|---|
| EP | 2025825 | A2 | 2/2009 |
| GB | 2111593 | A | 7/1983 |
| KR | 10-2011-0040968 | A | 4/2011 |
| KR | 10-2016-0035574 | A | 3/2016 |
| WO | 2005108837 | A1 | 11/2005 |
| WO | 2010015847 | A1 | 2/2010 |
| WO | 2011098764 | A2 | 8/2011 |
| WO | 2012041281 | A2 | 4/2012 |

OTHER PUBLICATIONS

International Search Report and Written Opinion dated Nov. 7, 2017 in counterpart international application No. PCT/GB2017/052354, 10 pp.

The Notification of Preliminary Rejection, and translation thereof, from counterpart Korean Application No. 10-2019-7003868, dated Sep. 28, 2021, 10 pp.

* cited by examiner

ENCLOSURE SYSTEM INCLUDING WIRE MESH AND THIN NON-POROUS MEMBRANE PANELS

This application is a national stage entry under 35 U.S.C. § 371 of International Application No. PCT/GB2017/052354, filed Aug. 9, 2017, which claims the benefit of GB Application 1613794.5, filed Aug. 11, 2016. The entire contents of International Application No. PCT/GB2017/052354 and GB Application 1613794.5 are incorporated herein by reference.

TECHNICAL FIELD

The present disclosure relates to the protection of personnel and equipment from injury and damage caused by projectiles and hazardous gas leaks generated as the result of a vacuum pump, valve or abatement equipment failure.

BACKGROUND

Deposition steps of semiconductor wafer processing employ a variety of precursor gases. These gases are often used inefficiently in the process, and any unused precursors and process by-products are pumped away from the chamber by vacuum pumps.

As the precursors and process by-products are pumped away from the chamber they continue to react and/or deposit solids inside the vacuum and/or abatement system. In particular, deposits can form in the dead volumes of the vacuum pumps that serve to convey the gases away from the chamber and in the exhaust lines and within abatement equipment through which the gases pass.

The maintenance of a semiconductor process chamber or vacuum and/or abatement system is usually carried out with great care to prevent exposure of any sections of the vacuum pump, valve or abatement equipment to oxygen or moisture during service of operation thereof.

For example, epitaxial processes use a mixture of chlorosilane precursors and hydrogen which are known to form potentially explosive deposits of polychlorosilane by-products in the pumping mechanism. At low pressure the process deposits do not pose a significant danger. However, upon exposure to the atmosphere, the deposits readily absorb oxygen which can start an energetic reaction between the deposited material and absorbed oxygen. The reaction may be of sufficient energy to cause an instantaneous explosion. This explosion may cause catastrophic failure of the body of the pump or the exhaust line. The explosion may result in projectiles of various sizes being formed, together with a corresponding increase in gas volume—thus creating a pressure wave.

Vacuum pump systems are often installed within enclosures. Such an enclosure may house several pumps, inlet lines, exhaust lines, valves and gas abatement equipment. The enclosures, on models such as the Edwards Limited Zenith™ combined pumping and abatement system, are manufactured from steel frames with thin gauge sheet metal. Removable panels are provided to allow service personnel access to the vacuum and abatement equipment installed within the enclosure. Provision of the enclosure permits the volume of gas defined therewithin to be extracted by the house duct system. This, in turn, protects personnel in the event of a gas leak from the equipment within the enclosure.

In the event of an explosive incident small projectiles, that are able to achieve higher velocities than larger projectiles, generally pass straight through the thin gauge sheet metal panels, whilst larger projectiles and the pressure wave created by expanding gas dislodge the panels from the supporting frame. These panels represent much larger projectiles which, in turn, create a potential source of injury or damage to either personnel or equipment in the vicinity.

One known method of preventing the generation of projectiles is to avoid the build up of potentially explosive deposits within the vacuum and/or abatement system. The continuous addition of gases such as oxygen or hydrochloric acid to a foreline of the pump during processing can cause a gradual reaction with the deposit within the vacuum and/or abatement system thus rendering it inert. However, many semiconductor wafer producers are reluctant to allow the addition of a reactive gas to the foreline due to concerns about the back-migration of the additive gases, which can affect the process chemistry in the process chamber.

Another known safety measure employed to mitigate damage by potential projectiles is to use high gauge, thick, steel for the enclosure housing the vacuum and/or abatement system. Such measures not only make it difficult for personnel to open and remove the doors to service the equipment housed in the enclosure but can also add a large capital cost to the equipment.

Therefore, there is a need in the industry for an improved enclosure system for the protection of personnel and equipment from injury and damage caused by projectiles generated as the result of a process by-product reaction whilst maintaining the ability to extract said enclosure to prevent injury due to leaks from the vacuum pump, abatement equipment and/or any associated ducts/valves.

SUMMARY

According to the present disclosure, there is provided an enclosure for minimising egress of hazardous gases released from post process chamber equipment during operation thereof, the enclosure comprising a structural frame describing an outer envelope of post process chamber equipment to be housed therein; an outlet, configured to be connected to an extraction system; and a plurality of panels, each panel comprising a sub-frame to which is connected a mesh layer in combination with a non-porous, membrane layer, the layers being substantially co-planar with one another, wherein the panels are mounted to the enclosure frame in a contiguous manner such that, in use, a pressure internal to the enclosure, lower than that experienced external to the enclosure, can be maintained thereby inhibiting inadvertent egress of any hazardous gases present in the enclosure.

One or more of the panels may be removably mounted to the enclosure frame. This enables easy access to the interior of the enclosure thus facilitating servicing of equipment housed therein.

The membrane may comprise a rubber, for example from the group of neoprene, butyl and nitrile, or a polymer for example from the group of polyvinyl chloride (PVC), polyethylene terephthalate (PET), polytetrafluorethylene (PTFE) or polyethylene (PE).

The membrane of the membrane layer may be configured to rupture when subjected to high pressures, such as those experienced upon catastrophic failure of equipment housed within the enclosure. Such a catastrophic failure may occur when by-products deposited within a vacuum pump, abatement equipment, ducts or valves of the system explode. The thickness of the membrane may be in the range of 0.05 to 0.5 mm, preferably in the range of 0.05 to 0.1 mm.

Alternatively, the membrane layer may be configured to flap out of plane of the panel when subjected to the high pressures generated upon catastrophic failure of equipment housed within the enclosure. Thus the high pressure wave can pass out of the enclosure and the energy of the blast may be more readily dissipated avoiding damage that may be caused by containment thereof. In this embodiment the thickness of the membrane in the membrane layer is preferably in the range of 0.5 to 3 mm, more preferably in the range of 1 to 2 mm.

The mesh layer may be configured to contain projectiles formed upon catastrophic failure of equipment housed within the enclosure. Optimally, the mesh layer may comprise two sheets of wire mesh. It has been found that provision of two layers of mesh serves to contain the resulting projectiles, whilst not significantly increasing the weight of the corresponding panel so that access to the enclosure can still readily be achieved for service personnel.

Where the panel comprises more than one sheet of wire mesh, the membrane layer may be provided between two of the sheets of wire mesh, alternatively it may be provided on one side of the mesh layer.

By enclosing a vacuum and/or abatement system with a wire mesh in combination with a thin membrane, any projectiles (generated by an energetic reaction of process by-product) hit the wire mesh, which causes the projectiles to lose momentum and thus reduce the likelihood of them injuring personnel or damaging neighbouring equipment. During normal operation, the thin, non-porous membrane seals the enclosed volume sufficiently to allow a slightly lower pressure (a few mbar) than atmospheric pressure to be maintained within the enclosure. This pressure difference enables the extraction of the enclosed volume and prevents leakage, into the working area, of hazardous gases originating from the vacuum and/or abatement system. Such an enclosure may be used to surround equipment employed to evacuate and abate a variety of semiconductor process chambers producing potentially explosive solid by-products, for example Epitaxial process chambers.

The use of wire mesh can replace the need for thick gauge steel plates, thus reducing the capital cost of the enclosure and increasing the ease with which the doors can be opened/panels removed by service personnel to access the equipment within the enclosure system. The use of a thin, non-porous, membrane creates a sufficient seal such that the enclosure system can be attached to an extract duct as a safety measure against possible dangerous gas leaks from any device housed within the enclosure system.

The generation of projectiles by an energetic reaction of process by-product will be accompanied by an instantaneous expansion of gas which will be generated in the explosive reaction. Therefore, it is advantageous that the panels, consisting of a wire mesh with a thin non-porous membrane, surrounding the pump comprise a means for the release of gas from within the enclosed volume. The ability to release and prevent the build-up of pressure generated in the explosion reduces the possible deformation of the wire mesh and/or ejection of the panel, which would compromise the protection offered by the wire mesh with a thin non-porous membrane.

The wire mesh with a membrane surrounding the pump and/or abatement equipment may, advantageously, be comprised of separate panels. This enables service personnel to gain access to a particular area of equipment by removing individual panels. The wire mesh with a membrane surrounding the equipment may comprise a plurality of separate panels, for example around each of the vertically extending sides of the pump and the enclosure floor and ceiling. Any combination of thick gauge steel and wire mesh with membrane panels can be utilised providing protection against projectiles propelled in all directions around the equipment.

Projectiles can be generated with velocities of between 10 m/s and 120 m/s. Those of greatest concern are those with a velocity of between 60 m/s and 120 m/s, therefore the wire mesh is preferably configured to prevent projectiles with a kinetic energy of between 150 joules and 450 joules from passing therethrough.

Other preferred and/or optional aspects of the disclosure are defined in the accompanying claims.

BRIEF DESCRIPTION OF THE DRAWINGS

In order that the present disclosure may be well understood, an embodiment thereof, which is given by way of example only, will now be described with reference to the accompanying drawing.

DETAILED DESCRIPTION

Figure 1:
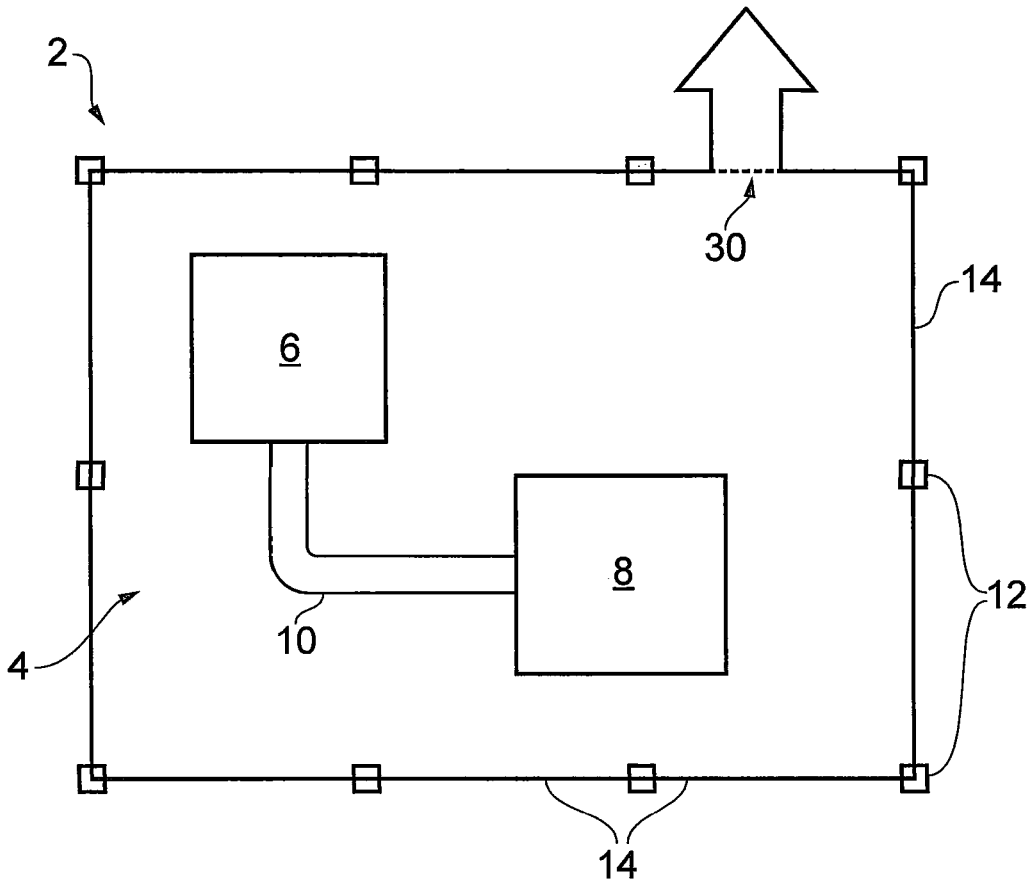
FIG. 1 illustrates a schematic representation of an enclosure according to the present disclosure.

FIG. 1 illustrates an enclosure system 2 according to the present disclosure. The enclosure system 2 is configured to encompass one or more pieces of equipment. The equipment represents a collection of apparatus located downstream of a semiconductor processing chamber that, in operation, receives harsh process gases therefrom. The process gases include unused precursor gases and by-products formed during the processing within the chamber. In this example, the post-chamber equipment 4, comprises a vacuum pump 6 connected to an abatement unit 8 via a conduit 10. One or more valves (not shown) would also be incorporated into the equipment 4. The equipment is in fluid communication with a process chamber, for example an epitaxial chamber (not shown) via a further conduit or foreline (not shown).

The enclosure system 2 comprises a metal frame 12 configured to describe an outer envelope of a working space surrounding the post-chamber equipment 4. A number of panels 14 are affixed to the frame 12 to form walls and a ceiling of the enclosure system 2. One or more of the panels 14 may be removably connected to the frame 12 or they may be configured to be connected using a hinge, or similar mechanism, to form doors. Thus, access points into the enclosure system 2, and therefore any equipment therein, by service personnel may be provided. Such access may be effected either by opening the doors and/or completely removing the, or each, respective panel from the enclosure.

Figure 2:
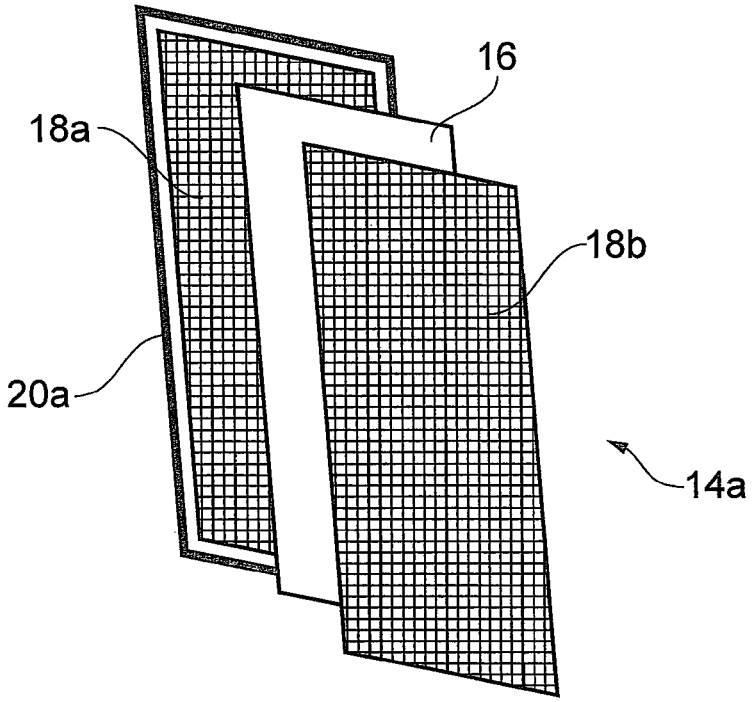
FIG. 2 illustrates a first panel that may be used to form the enclosure of the present disclosure.

FIG. 2 illustrates one embodiment of a panel 14*a* which may be used to form the walls of the enclosure system 2. Panel 14*a* is a three-layer panel and comprises a thin, non-porous membrane 16*a* sandwiched in between two, similarly sized, wire mesh panels 18*a* and 18*b*. A first wire mesh panel 18*a*, a base panel, is provided with an external structural framework 20*a* extending around the perimeter of the mesh panel 18*a*, to provide structural integrity thereto. The mesh 18*a* may be secured to the framework 20*a* by conventional means for example by welding or bonding. When installed, the panels 14 are placed in a contiguous manner on the frame 12 of the enclosure 2. The panels 14 are then secured to the frame 12 to hold them in place. Each panel 14 may be secured to the frame 12 at each corner and/or along edges of the panel 14. Means for securing each panel 14 to the frame 12, may comprise permanent fixings such as bolts or hinges. If hinges are used, then the opposing side of the panel is secured using a latch or locking mechanism to retain the panel 14 in a closed configuration during operation of the vacuum and/or abatement system. Alternatively, impermanent fixings such as straps may be implemented.

Figure 3:
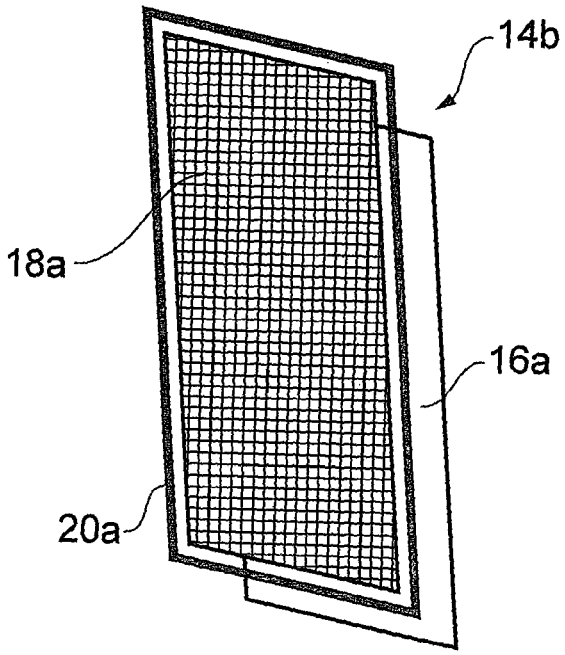
FIG. 3 illustrates a second panel that may be used to form the enclosure of the present disclosure.

An alternatively configured panel 14*b* is illustrated in FIG. 3. In this embodiment, a mesh panel 18*a* is provided as the base panel, having an external structural framework 20*a*. A thin, non-porous membrane 16*a* is overlaid on the mesh panel 18*a* and secured thereto via the framework 20*a*, alternatively, the membrane 16*a* may be bonded directly to a mesh sheet of the mesh panel 18*a*.

Figure 4:
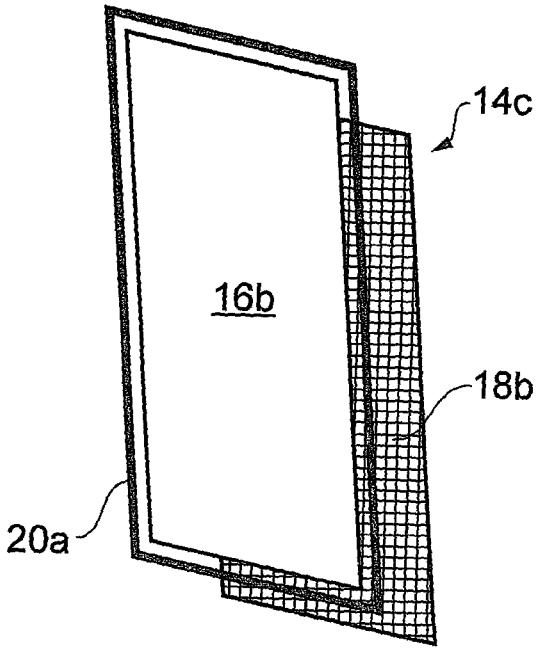
FIG. 4 illustrates a third panel that may be used to form the enclosure of the present disclosure.

In a further alternative, as illustrated in FIG. 4, it may be that the membrane 16*b* of panel 14*c* is secured e.g. by bonding to the panel framework 20*a* to form a base panel and then a mesh panel 18*b* is secured thereto.

Upon installation, panels 14*b* and 14*c* may be orientated such that the membrane 16 forms an internal surface of the enclosure 2 with the mesh 18 representing the external surface or the membrane 16 may be the external surface with the mesh 18 forming an internal surface.

Each mesh panel 18 may comprise a single sheet of wire mesh or it may comprise a number of sheets of wire mesh in combination. Preferably, two wire mesh sheets are provided in each panel 14, either using the configuration illustrated in FIG. 2 or by providing two mesh sheets in the mesh panel 18*a* in the embodiment shown in FIG. 3 or in the mesh panel 18*b* in the embodiment shown in FIG. 4.

The membrane material may comprise a rubber (for example from the group of neoprene, butyl and nitrile) or it may comprise a polymer (for example from the group of PVC, PET, PTFE, PE), however, any thin, frangible, non-porous material may be used. The membrane or film used in panels 14*a*, 14*b*, 14*c* would have a thickness in the range of 0.05 to 0.5 mm, more preferably in the range of 0.05 to 0.1 mm.

Figure 5:
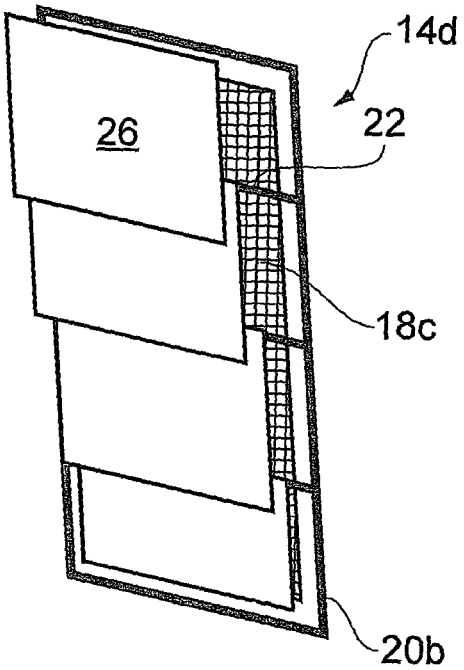
FIG. 5 illustrates a fourth panel that may be used to form the enclosure of the present disclosure.
Figure 6:
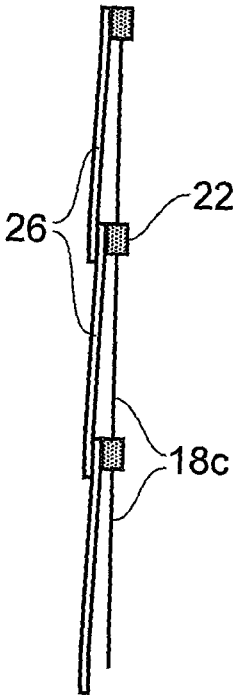
FIG. 6 illustrates the side view of the fourth panel illustrated in FIG. 5.

An alternatively configured panel 14*d* is illustrated in FIGS. 5 and 6. A base panel 18*c*, in this instance formed of a mesh layer surrounded and supported by a structural framework 20*b*. Members of the structural framework 20*b* extend not only around the perimeter of panel 14*d* but also form intermediate cross bracing members 22 to sub-divide the panel into multiple sections. These members 22 allow for an alternate fixing locations to which the membrane/film can be connected. In this embodiment, a plurality of membrane sheets 26 can be provided, in contrast to the aforementioned single film 16 in earlier embodiments. As illustrated in FIG. 6, each membrane sheet 26 is fixed to the structural framework 20*b* along a single edge only, at a cross-bracing member 22. Each membrane sheet 26 may be secured to a respective member 22 by bonding or by clamping the sheet between the member and a securing bar or plate (not illustrated). The securing bar may be held in place by riveting or bolting through the bar to the bracing member 22. The remaining edges of the membrane sheet are left unsecured but do lie substantially co-planar to the mesh 18*c* of the panel 14*d*. As is readily apparent, the mesh 18*c* of this configuration may be provided in a single sheet across the width and height of framework 20*b* or it may, too, be provided in sections, secured at members 22. Upon installation, the panel 14*d* would be oriented such that the membrane sheets 26 are positioned on the outside of the enclosure 2 to represent the external surface thereof. The membrane sheets 26 differ from the earlier mentioned membranes 16*a*, 16*b* in that their thickness is somewhat increased to minimize distortion thereof such that coverage of the panel 14*d* is maintained. The thickness of membrane sheets 26 may be in the range of 0.5 to 3 mm, more preferably in the range of 1 mm to 2 mm.

Returning to FIG. 1, the enclosure system 2 further comprises an outlet 30, through which the atmosphere within the enclosure may be drawn/extracted to replenish the air surrounding the vacuum and/or abatement system 4 during operation. Extraction means (not shown) are provided in fluid communication with the outlet 30. Said extraction means may comprise sensor means configured to detect any process fluids that ought not to be present in the atmosphere of the enclosure during operation of the vacuum and/or abatement system 4. If such process fluids are detected by sensor means within the extraction means, this is indicative of a leak in the vacuum and/or abatement system 4. Detection of such a leak results in an alert signal being created and, consequently, steps can be taken to mitigate the fault, either by immediately shutting down the apparatus or by scheduling maintenance at an appropriate time. The mitigation steps implemented are likely to be dependent on the perceived severity of the leak.

Continuous extraction during operation is necessary as a safety precaution to prevent any leaked hazardous process fluids from contaminating the atmosphere outside the enclosure where personnel are located. The rate of extraction from the enclosure 2 is typically in the order of 4 to 5 air changes per minute.

The configuration of the enclosure system 2 must be such to enable extraction to occur. In other words, whilst the panels 14 need not be hermetically sealed to one another via the frame 12, a sufficient level of sealing must be achieved to prevent/inhibit ingress of air so that a pressure differential (of a few, say 2 to 20 mbar) between the interior and the exterior of the enclosure can be maintained. Thereby the enclosure system 2 retains any hazardous gases in the vicinity of the vacuum and/or abatement system 4 and the volume of the enclosure is safely extracted via an extraction duct connected to outlet 30.

If a failure event is experienced, whereby material deposited within the equipment 4 becomes explosive, two primary effects will be realised. Fragments of the body of the apparatus will be formed as the catastrophic failure occurs. These fragments will form high velocity projectiles, capable of wreaking serious damage upon proximate equipment. The second aspect of the explosive incident will be a significant high pressure disturbance which, if contained, can also cause a great deal of damage to structural components in the area. Indeed, in a conventional system, such a pressure wave can destroy the enclosure and turn the panels of the enclosure itself into further projectiles that are likely to contribute to the damage caused.

In an enclosure of the type represented by the present disclosure, these catastrophic effects are somewhat mitigated. In the first instance, the thin membranes 16 would be ruptured by the overpressures created by the explosion. Consequently, rather than containing and reflecting the overpressure, the high pressure wave will be transmitted outside the enclosure and will rapidly be dissipated. Energy will be dispersed and hence, the panels 14 of the enclosure system 2 will not be dislodged simply by virtue of the overpressures experienced within the enclosure. In the alternative embodiment illustrated in FIGS. 5 and 6, the membrane sheets 26 will not be ruptured but, rather, will be forced away from the mesh panel 18*c* to release the gasses and thus dissipate the high pressures.

The mesh sheets of the panels 18 absorb and disperse the impact energy of projectiles formed from the fragments of the apparatus generated during the explosive incident. As an example, each mesh sheet serves to prevent projectiles having kinetic energy of between 150 joules and 450 joules from escaping from the enclosure system. Additional energy from projectiles is absorbed by each successive mesh sheet of a panel 18 until all the energy is removed and the projectiles are eventually stopped or at least slowed significantly to minimize the damage caused thereby. It is preferred that two mesh sheets are provided in each panel as discussed above.

As a result, providing an enclosure according to the present disclosure around a vacuum and/or abatement system, serves to protect personnel working in the vicinity from injury caused by projectiles generated as a result of an energetic reaction of process by-product of the pump, valve or abatement equipment.

Whilst the embodiments described herein comprise panels according to the disclosure exclusively, it is envisaged that these panels can be provided in combination with more conventional metal plates for some sections of the enclosure but the effectiveness of the mitigating measures will, correspondingly be reduced and the plates may represent hazardous projectiles. Alternatively, the support structure 20 of some or each of the panels 14 may be formed integrally with the structural frame 12 of the enclosure 2. In this instance the enclosure will take longer to install and access into the enclosure would be less readily achieved. A combined approach is envisaged in this integral approach, whereby one or more sections of the enclosure comprise panels 14 of the type comprising an external structural framework 20 that can be removably mounted on and connected to the main enclosure frame 12.

The invention claimed is:

1. An enclosure for minimising egress of hazardous gases released from post process chamber equipment during operation thereof, the enclosure comprising:

a structural frame describing an outer envelope of post process chamber equipment to be housed therein;

an outlet configured to be connected to an extraction system; and a plurality of panels, each panel of the plurality of panels comprising a respective sub-frame to which is connected a respective mesh layer in combination with a respective non-porous membrane layer, the respective mesh and respective non-porous membrane layers of each panel being substantially co-planar with one another, wherein the plurality of panels are mounted to the structural frame in a contiguous manner such that, in use, a pressure internal to the enclosure, lower than that experienced external to the enclosure, can be maintained thereby inhibiting inadvertent egress of any hazardous gases present in the enclosure.

2. The enclosure according to claim 1, wherein one or more panels of the plurality of panels are removably mounted to the structural frame.

3. The enclosure according to claim 1, wherein the respective non-porous membrane layers comprise a rubber or a polymer.

4. The enclosure according to claim 1, wherein the respective non-porous membrane layers are configured to rupture upon catastrophic failure of equipment housed within the enclosure.

5. The enclosure according to claim 4, wherein the thickness of the respective non-porous membrane layers is in the range of 0.05 to 0.5 mm.

6. The enclosure according to claim 5, wherein the thickness of the respective non-porous membrane layers is in the range of 0.05 to 0.1 mm.

7. The enclosure according to claim 1, wherein the respective non-porous membrane layers are configured to flap out of plane upon catastrophic failure of equipment housed within the enclosure.

8. The enclosure according to claim 1, wherein the thickness of the respective non-porous membrane layers is in the range of 0.5 to 3 mm.

9. The enclosure according to claim 1, wherein the thickness of the respective non-porous membrane layers is in the range of 1 to 2 mm.

10. The enclosure according to claim 8, wherein the respective mesh layers are configured to contain projectiles formed upon catastrophic failure of equipment housed within the enclosure.

11. The enclosure according to claim 8, wherein the respective non-porous mesh layers each comprise two sheets of wire mesh.

12. The enclosure according to claim 1, wherein the respective non-porous membrane layers are each provided between the two sheets of wire mesh.

* * * * *